US011176916B2

(12) United States Patent
Yamamura et al.

(10) Patent No.: US 11,176,916 B2
(45) Date of Patent: Nov. 16, 2021

(54) KEYBOARD DEVICE AND ELECTRONIC MUSICAL INSTRUMENT

(71) Applicant: Roland Corporation, Shizuoka (JP)

(72) Inventors: Tateki Yamamura, Shizuoka (JP); Yoshiki Takaki, Shizuoka (JP); Yukihide Takata, Shizuoka (JP); Hitoshi Sato, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/565,432

(22) Filed: Sep. 9, 2019

(65) Prior Publication Data

US 2020/0111464 A1 Apr. 9, 2020

(30) Foreign Application Priority Data

Oct. 9, 2018 (JP) ..... JP2018-191059

(51) Int. Cl.

| | |
|---|---|
| ***G10H 1/34*** | (2006.01) |
| ***G10C 3/12*** | (2006.01) |
| ***G10H 1/053*** | (2006.01) |

(52) U.S. Cl.

CPC ..... *G10H 1/34* (2013.01); *G10C 3/12* (2013.01); *G10H 1/0535* (2013.01)

(58) Field of Classification Search

CPC .. G10H 1/34; G10H 1/0535; G10H 2220/461; G10H 1/346; G10H 2220/311; G10C 3/12

See application file for complete search history.

(56) References Cited

U.S. PATENT DOCUMENTS

| | | | | |
|---|---|---|---|---|
| 4,211,139 A * | 7/1980 | Murakami | ..... | G10H 3/185 84/731 |
| 7,952,010 B2 * | 5/2011 | Minakawa | ..... | G10C 3/125 84/423 R |
| 9,240,171 B1 * | 1/2016 | Satoh | ..... | G10H 3/22 |

FOREIGN PATENT DOCUMENTS

| | | |
|---|---|---|
| JP | 2008046370 | 2/2008 |
| JP | 2010160413 | 7/2010 |
| JP | 2011221248 | 11/2011 |
| JP | 2011237493 | 11/2011 |
| JP | 2013037224 | 2/2013 |
| JP | 2013137434 | 7/2013 |
| JP | 2015132847 | 7/2015 |
| JP | 2016118794 | 6/2016 |

* cited by examiner

*Primary Examiner* — Kimberly R Lockett
(74) *Attorney, Agent, or Firm* — JCIPRNET

(57) ABSTRACT

The disclosure provides a keyboard device and an electronic musical instrument. The keyboard device includes: a plurality of keys 60 arranged in a left-right direction (scale direction); a base member 50 supporting the keys 60; a vibration transmission member 70 being in contact with the base member 50 across an arrangement region of the keys 60 in the left-right direction; and a vibrator 72 fixed to the vibration transmission member 70 and vibrating based on pressing of the key 60. Therefore, the vibration of the vibrator 72 is transmitted to each of the keys 60 (base member 50) arranged on the left and right via the vibration transmission member 70. As the vibration transmission member 70 has higher rigidity than the base member 50 made of resin, the vibration of the vibrator 72 is easily transmitted in the left-right direction through the vibration transmission member 70.

22 Claims, 4 Drawing Sheets

KEYBOARD DEVICE AND ELECTRONIC MUSICAL INSTRUMENT

CROSS REFERENCE TO RELATED APPLICATIONS

This application claims the priority benefit of Japanese Patent Application No. 2018-191059, filed on Oct. 9, 2018. The entirety of the above-mentioned patent application is hereby incorporated by reference herein and made a part of this specification.

BACKGROUND

Technical Field

The disclosure relates to a keyboard device and an electronic musical instrument, and more particularly relates to a keyboard device and an electronic musical instrument that can efficiently transmit the vibration of a vibrator to each key arranged in a scale direction.

Description of Related Art

When a performer plays an acoustic piano, the vibration of the string generated by pressing the key is transmitted to the performer via the key. In order to simulate this feeling of playing, a technique has been proposed, which is to dispose a vibrator in a keyboard device for vibrating the key when the key is pressed. For example, Patent Document 1 describes a keyboard device in which a vibration generator (vibrator) is fixed to a frame (base member) that supports the key. According to such a keyboard device, the vibration generator vibrates when the key is pressed and thereby the vibration is transmitted to the key via the frame, so it is possible to give the performer the feeling of playing an acoustic piano. In this way, a technology that obtains skin sensation feedback by tactile sensation and feeling by applying vibration to the performer's fingers is called haptic technology.

RELATED ART

Patent Document

[Patent Document 1] Japanese Laid-Open No. 2008-046370 (paragraph [0013] and FIG. 1, for example)

Problems to be Solved

However, for the conventional technique described above, if the base member is formed of a material having relatively low rigidity (a resin material, for example), it will be difficult for the vibration of the vibrator to be transmitted to the key positioned away from the vibrator in the scale direction (key arrangement direction). That is, there is a problem that the vibration of the vibrator cannot be efficiently transmitted to each key arranged in the scale direction.

SUMMARY

A keyboard device according to the disclosure includes: a plurality of keys arranged in a scale direction; a base member supporting the keys; a vibration transmission member formed with higher rigidity than the base member and being in contact with the base member across an arrangement region of the keys in the scale direction; and a vibrator fixed to the vibration transmission member and vibrating based on pressing of the key.

An electronic musical instrument according to the disclosure includes: a plurality of keys arranged in a scale direction; a base member supporting the keys; a vibration transmission member formed with higher rigidity than the base member and being in contact with the base member across an arrangement region of the keys in the scale direction; and a vibrator fixed to the vibration transmission member and vibrating based on pressing of the key.

DESCRIPTION OF THE EMBODIMENTS

Figure 1:
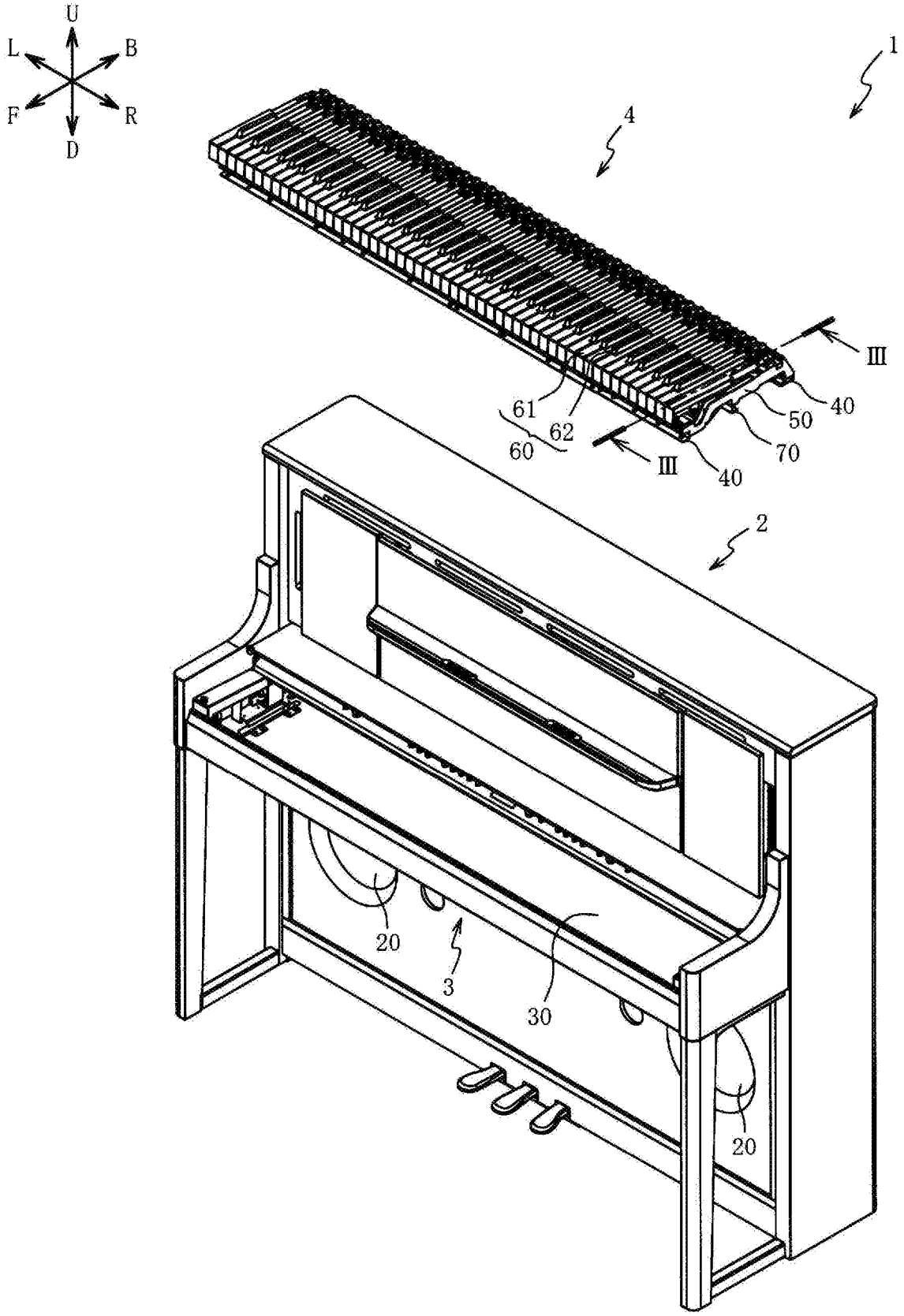
FIG. 1 is a front perspective view of the keyboard device according to an embodiment.
Figure 2:
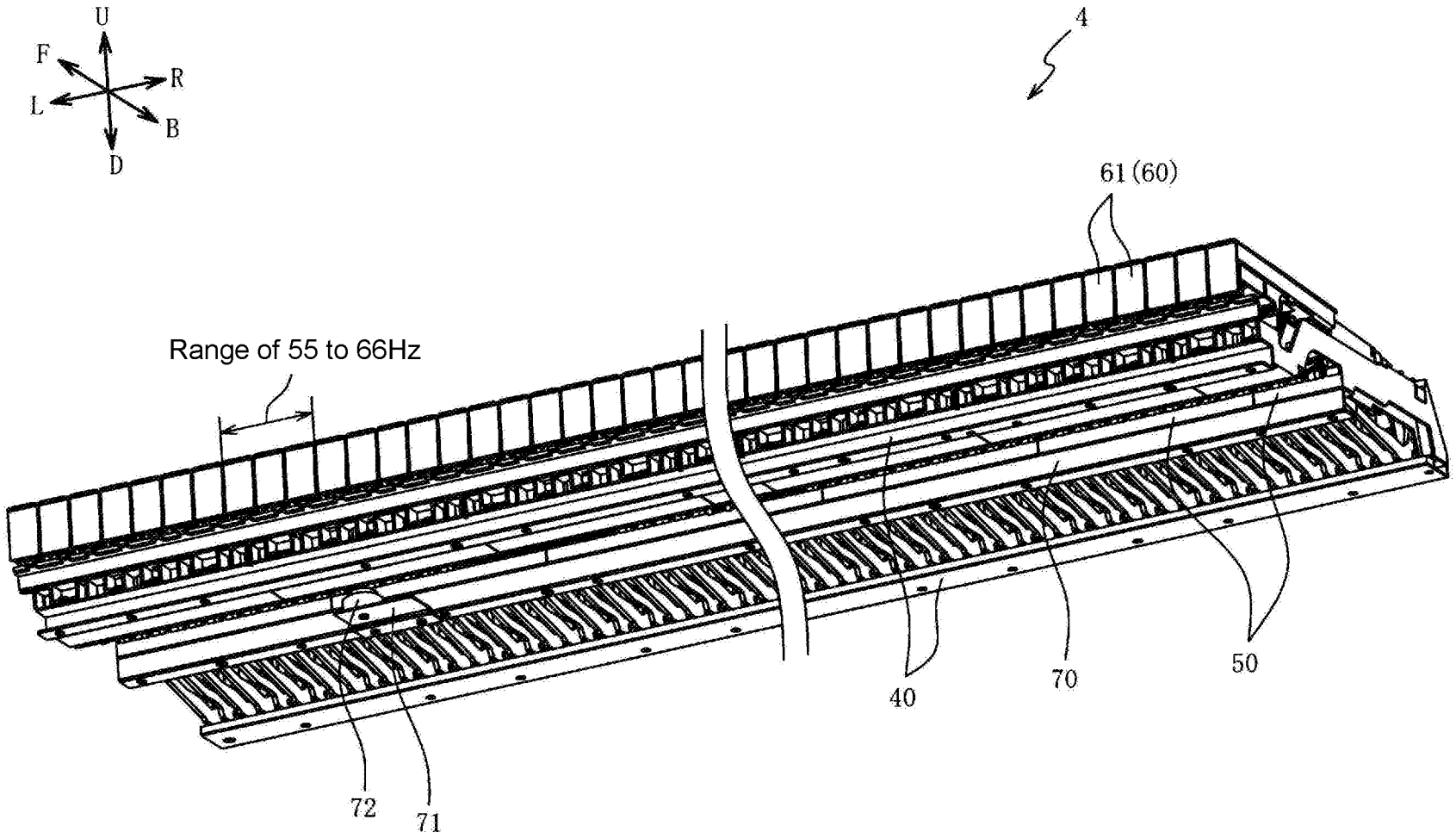
FIG. 2 is a bottom perspective view of the keyboard unit.

Hereinafter, exemplary embodiments will be described with reference to the accompanying drawings. First, the overall configuration of a keyboard device 1 will be described with reference to FIG. 1 and FIG. 2. FIG. 1 is a front perspective view of the keyboard device 1 according to an embodiment and FIG. 2 is a bottom perspective view of a keyboard unit 4. FIG. 1 shows a state where the keyboard unit 4 is removed from a keyboard table 3, and a keyboard lid for covering the upper surface side of the keyboard unit 4 when the keyboard unit 4 is disposed on the keyboard table 3 is omitted. In addition, the arrow U direction, the arrow D direction, the arrow F direction, the arrow B direction, the arrow L direction, and the arrow R direction in FIG. 1 and FIG. 2 respectively indicate the up direction, the down direction, the front direction, the back direction, the left direction, and the right direction of the keyboard device 1. The same applies to FIG. 3.

As shown in FIG. 1, the keyboard device 1 is configured as a keyboard musical instrument (electronic piano) which includes a body part 2, the keyboard table 3 that protrudes forward from the front surface of the body part 2 in the center of the up-down direction (direction of the arrows U-D), and the keyboard unit 4 supported by the keyboard table 3.

The body part 2 is a rectangular parallelepiped case, and speakers 20 are provided on the front surface of the body part 2. The speakers 20 are provided in pair at a predetermined interval in the left-right direction (direction of the arrows L-R), and the keyboard table 3 is disposed above the pair of speakers 20.

The keyboard table 3 is formed with a concave space that is recessed downward for housing the keyboard unit 4, and a chassis 30 is provided on the bottom surface of the concave space. The chassis 30 is a metallic plate-shaped body that is long in the left-right direction, and the keyboard unit 4 is fixed to the upper surface of the chassis 30.

The keyboard unit 4 includes a pair of support members 40 for fixing the keyboard unit 4 to the chassis 30, base members 50 made of resin and supported by the pair of support members 40, a plurality of (88 in the present embodiment) keys 60 supported by the base members 50, and a vibration transmission member 70 for transmitting the vibration of a vibrator 72 (see FIG. 2), which will be described later, to the keys 60.

The support member 40 is a metallic light channel steel (C-shaped steel having a U-shaped cross section) and is formed in an elongated shape that is long in the left-right direction (scale direction) in which the keys 60 are arranged. The "elongated shape" refers to a rod shape or a tube shape having a left-right direction dimension (length) that is sufficiently larger (20 times, for example) than the front-back direction (direction of the arrows F-B) dimension and the up-down direction dimension (thickness of the object). The same applies to the following description. The front end and the back end of the base members 50 are respectively fixed to the pair of support members 40, and the keys 60 are supported by the upper surfaces of the base members 50.

The keys 60 include a plurality of (52 in the present embodiment) white keys 61 for playing natural tones, and a plurality of (36 in the present embodiment) black keys 62 for playing derived tones. The white keys 61 and the black keys 62 are arranged in the left-right direction.

As shown in FIG. 2, a plurality of (8 in the present embodiment) base members 50 are arranged in the left-right direction (direction of the arrows L-R). Among the base members 50, the seven base members 50, excluding the base member 50 positioned on the highest pitch side (the one that supports three white keys 61 and one black key 62), support the keys 60 for one octave.

The base members 50 are respectively connected by the pair of support members 40 and the vibration transmission member 70, and the vibration transmission member 70 is fixed to the base members 50 (along the left-right direction) from the low pitch side end portion of the base member 50 positioned on the lowest pitch side (the side of the arrow L) to the high pitch side end portion of the base member 50 positioned on the highest pitch side (the side of the arrow R). That is, the vibration transmission member 70 is provided in contact with all the base members 50.

The vibration transmission member 70 is a metallic light channel steel and is formed in an elongated shape that is long in the left-right direction. One vibrator 72 is fixed to the vibration transmission member 70 via a plate 71. The vibrator 72 is provided with a magnetic circuit, a voice coil or the like, and is, for example, a drive device for vibrating a diaphragm of the speaker. Since the vibrator 72 may adopt a known configuration, the detailed description thereof is omitted.

The plate 71 is a metallic plate-shaped body that has a left-right direction dimension smaller than that of the vibration transmission member 70 and a front-back direction (direction of the arrows F-B) dimension smaller than that of the base member 50. The back end portion of the plate 71 is fixed to the lower surface of the vibration transmission member 70, and the vibrator 72 is fixed to the upper surface of the plate 71.

The vibrator 72 vibrates based on the pressing of the key 60, and the vibration of the vibrator 72 is transmitted to the vibration transmission member 70 via the plate 71 so that the vibration transmission member 70 also vibrates. Since the vibration transmission member 70 connects the base members 50 arranged on the left and right, and each key 60 is supported by the base member 50, the vibration of the vibrator 72 is transmitted to each of the keys 60 (each of the base members 50) arranged on the left and right via the vibration transmission member 70.

Since the metallic vibration transmission member 70 has higher rigidity than the base member 50 made of resin, the vibration of the vibrator 72 is easily transmitted in the left-right direction through the vibration transmission member 70. Therefore, compared with a case where the vibrator 72 is directly fixed to the base members 50, the disclosure can efficiently transmit the vibration of the vibrator 72 to each key 60 arranged in the left-right direction. That is, when the key 60 disposed at a position away from the vibrator 72 in the left-right direction is pressed, the vibration of the vibrator 72 can be easily transmitted to the pressed key 60. Thus, each of the keys 60 arranged on the left and right can be vibrated by the vibration of one vibrator 72 fixed to the vibration transmission member 70 when the key 60 is pressed.

In addition, the back end portion of the plate 71 is fixed to the vibration transmission member 70, and the vibrator 72 is fixed to the front end side of the plate 71 so that the vibrator 72 is fixed to the plate 71 at a position away from the fixing portion of the vibration transmission member 70 and the plate 71. That is, the plate 71 to which the vibrator 72 is fixed is supported at one end by the vibration transmission member 70. Therefore, the plate 71 itself is easily vibrated by the vibration of the vibrator 72. Since the vibration of the vibrator 72 can be amplified by the plate 71 and transmitted to the vibration transmission member 70, the vibration of the vibrator 72 can be efficiently transmitted to each key 60 arranged in the left-right direction.

Moreover, since the vibration transmission member 70 connects each of the base members 50 arranged on the left and right, even if each base member 50 is configured separately, the vibration of the vibrator 72 can still be transmitted to the key 60 supported by each base member 50 at once (approximately at the same time). That is, since the vibration can be transmitted to all the keys 60 by one vibration transmission member 70 and one vibrator 72, the number of parts can be reduced. Furthermore, in addition to the function of transmitting vibration to each base member 50 (each key 60), the vibration transmission member 70 can also provide the function of connecting the base members 50. From this point, the number of parts can be reduced.

Here, if the purpose is to facilitate transmission of the vibration simply with a member that has higher rigidity than the base member 50, the vibration transmission member 70 may be formed in a plate shape (for example, a plate shape having a front-back direction dimension smaller than that of the base member 50 but having the dimension that can be fixed to the base member 50). However, in such a configuration, due to the vibration of the vibrator 72, the plate-shaped vibration transmission member 70 may vibrate like a diaphragm of a speaker to generate an audible sound, which may result in noise during performance.

Regarding this, in the present embodiment, the up-down direction dimension and the front-back direction dimension of the vibration transmission member 70 are set smaller than those of the base member 50, and the vibration transmission member 70 is formed in an elongated shape that is long in the left-right direction (a rod having a U-shaped cross section (C shape)). Since the vibration transmission member 70 can be suppressed from vibrating like a diaphragm due to the vibration of the vibrator 72 and from generating an audible sound, generation of noise during performance can be suppressed.

Figure 3:
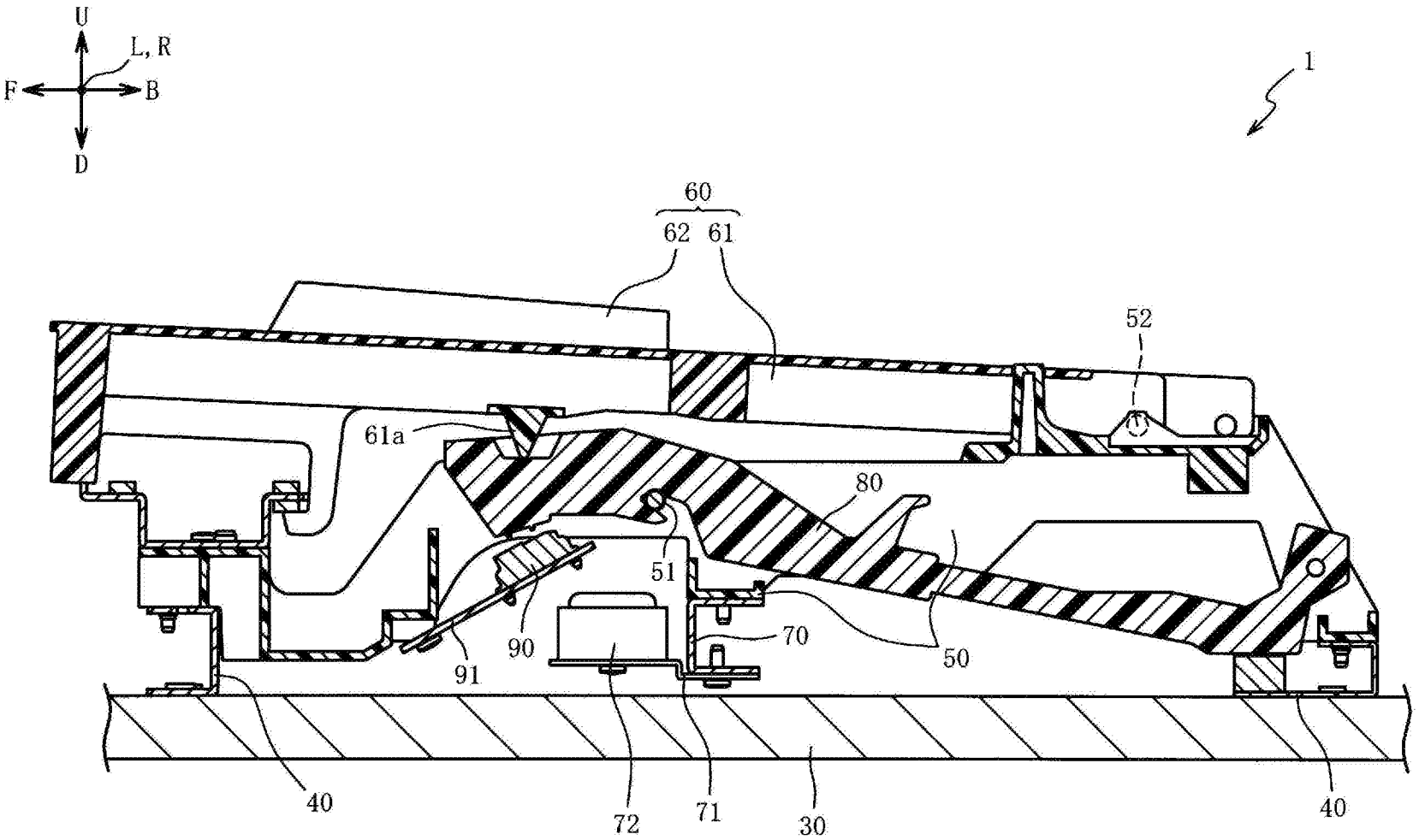
FIG. 3 is a cross-sectional view of the keyboard device taken along the line in FIG. 1.

Next, a detailed configuration of the keyboard device 1 will be described with reference to FIG. 3. FIG. 3 is a cross-sectional view of the keyboard device 1 taken along the line in FIG. 1. FIG. 3 shows a cross section cut along a plane orthogonal to the left-right direction. Moreover, in order to simplify the drawing, a part of the keyboard device 1 is omitted from FIG. 3.

As shown in FIG. 3, the keyboard device 1 includes a hammer 80 pivotally supported to be rotatable around a rotation shaft 51 of the base member 50, and a key pressing sensor 90 for detecting key pressing information of the key 60 from the rotation state of the hammer 80.

The structures for pivotally supporting (supporting) the white keys 61 and the black keys 62 to be rotatable with the base members 50, the structures for guiding the rotation thereof, and the structures for rotating the hammers 80 in conjunction with the key pressing or key release are substantially the same for the white keys 61 and the black keys 62. Therefore, only the structure of the white key 61 will be described hereinafter, and the description of the structure of the black key 62 will be omitted. Nevertheless, the operation and effects of the configuration of the white key 61 described below are also exhibited by the black key 62.

The back end portion of the white key 61 is pivotally supported to be rotatable around a rotation shaft 52 on the upper surface on the back end (end portion on the side of the arrow B) side of the base member 50, and a protrusion 61*a* is formed to protrude downward (the side of the arrow D) from the lower surface of a substantially central portion of the white key 61 in the front-back direction (direction of the arrows F-B). The protrusion 61*a* is a part for transmitting the rotational force that comes with the rotation of the white key 61 to the hammer 80, and the protruding tip portion of the protrusion 61*a* is in contact with the hammer 80.

The hammer 80 is a mass body (having a weight sufficient to create the feeling of key pressing) for creating the feeling of key pressing when the white key 61 is pressed, and the hammer 80 is pivotally supported by the rotation shaft 51 positioned on the back side of the contact portion of the hammer 80 and the protrusion 61*a*. When the white key 61 is pressed, the protrusion 61*a* of the white key 61 slides along the upper surface of the hammer 80 so that the hammer 80 rotates around the rotation shaft 51 (the portion on the front end side of the hammer 80 is displaced downward), and the reaction force accompanying the rotation of the hammer 80 gives the performer the feeling of pressing the white key 61 (key pressing feeling).

The key pressing sensor 90 is fixed to the lower surface of the base member 50 via a plate-shaped body 91, and the key pressing sensor 90 is disposed to face the lower surface on the front end side of the hammer 80. The hammer 80 rotates around the rotation shaft 51 (the portion on the back end side of the hammer 80 is displaced downward or upward) as the white key 61 is pressed or released so that the key pressing sensor 90 is turned on/off by the portion on the back end side of the hammer 80. The key pressing information (note information) of the white key 61 is detected through the on/off operation of the switch, and a musical sound signal based on the detection result is outputted to the outside.

When the key pressing information of the white key 61 is detected by the key pressing sensor 90, the vibrator 72 vibrates based on the key pressing information. The vibration of the vibrator 72 is transmitted to each of the base members 50 arranged on the left and right via the vibration transmission member 70 as described above, but in the present embodiment, the configuration can efficiently transmit the vibration transmitted to the base member 50 to the key 60 (white key 61 or black key 62). The configuration will be described below.

The base member 50 is fixed to bridge between a pair of support members 40 disposed at a predetermined interval in the front-back direction. That is, the front end side and the back end side of the base member 50 are respectively fixed to the chassis 30 via the support members 40, and in the region between a pair of support members 40 in the front-back direction, the chassis 30 and the base member 50 are disposed not in contact with each other (at a predetermined interval in the up-down direction). Therefore, when the vibration is transmitted to the base member 50, the substantially central portion of the base member 50 in the front-back direction becomes the antinode of vibration, and the amplitude of the vibration tends to be maximum in the substantially central portion of the base member 50 in the front-back direction.

In the present embodiment, the vibration transmission member 70 is fixed to the lower surface of substantially the center of the base member 50 in the front-back direction, and the vibration transmission member 70 and the vibrator 72 (plate 71) are disposed not in contact with the chassis 30. Since the vibration from the vibrator 72 can be transmitted to the portion, which serves as the antinode of the vibration, of the base member 50, the base member 50 itself is easily vibrated by the vibration (the vibration of the vibrator 72 can be amplified by the antinode portion of the base member 50). Therefore, the vibration of the vibrator 72 transmitted to the base member 50 via the vibration transmission member 70 can be efficiently transmitted to the white key 61.

"Substantially the center in the front-back direction" of the base member 50 refers to a predetermined region in the front-back direction from the center of the base member 50 in the front-back direction (for example, within a region of 25% of the front-back direction dimension of the base member 50). If the vibration transmission member 70 is disposed in the region, that is, at least the region between the front and back fixing positions at which the base member 50 is fixed to the chassis 30 (between a pair of support members 40), the vibration of the vibrator 72 can easily vibrate the base member 50 itself.

In addition, since the vibration transmission member 70 and the vibrator 72 (plate 71) are disposed not in contact with the chassis 30, the vibration of the vibrator 72 can be suppressed from being transmitted to the plate-shaped chassis 30. Thus, it is possible to suppress the vibration of the vibrator 72 from being dispersed to the side of the chassis 30, and suppress the plate-shaped chassis 30 from vibrating like a diaphragm of a speaker due to the vibration of the vibrator 72. Therefore, compared with a case where the vibration transmission member 70 or the vibrator 72 (plate 71) is provided in contact with the chassis 30, for example, the disclosure can efficiently transmit the vibration of the vibrator 72 to the white key 61 via the vibration transmission member 70, and suppress the generation of noise resulting from the vibration of the plate-shaped chassis 30.

Furthermore, the base member 50 is fixed to the chassis 30 (support members 40) not via a vibration proof member (a rubbery elastic body, for example). Thus, the portions on the front and back two end sides, which serve as the nodes of the vibration, of the base member 50 can be firmly fixed to the chassis 30. Therefore, by providing the vibration transmission member 70 in the central portion (the portion that serves as the antinode of the vibration) of the base member 50 in the front-back direction, which has relatively lower rigidity than the portions on the front and back two end sides that are firmly fixed to the chassis 30, the base member 50 itself can be vibrated more effectively. Therefore, the vibration of the vibrator 72 transmitted to the base member 50 via the vibration transmission member 70 can be efficiently transmitted to the white key 61.

On the other hand, since the back end of the base member 50 is firmly fixed to the chassis 30, the back end portion of the white key 61 pivotally supported by the back end side of the base member 50 has a structure that is hard to vibrate. In addition, if the vibration transmitted to the base member 50 is transmitted to the pressable surface (surface where the performer feels the vibration when pressing the key) on the front end side of the white key 61 via the rotation shaft 52, the vibration transmission path is long and it is difficult for the performer to feel the vibration of the vibrator 72 when pressing the white key 61. The pressable surface refers to a surface that allows the key 60 to rotate when it is pressed by the performer. For the white key 61, the upper surface positioned on the front side with respect to the back end of the black key 62 (portion that protrudes from the upper surface of the white key 61) corresponds to the pressable surface, and for the black key 62, the upper surface of the portion that protrudes from the upper surface of the white key 61 corresponds to the pressable surface.

Regarding this, the present embodiment includes the hammer 80 that is pivotally supported by the base member 50 and brought into contact with the white key 61. Therefore, the vibration from the vibration transmission member 70 is easily transmitted to the pressable surface (front end side) of the white key 61 via the hammer 80.

That is, the vibration transmission path from the vibration transmission member 70 to the pressable surface of the white key 61 through the base member 50, the rotation shaft 51 of the hammer 80, the hammer 80, and the contact position of the hammer 80 and the protrusion 61*a* is formed shorter than the vibration transmission path from the vibration transmission member 70 to the pressable surface of the white key 61 through the base member 50 and the rotation shaft 52 of the white key 61.

More specifically, since the vibration transmission member 70, the rotation shaft 51 of the hammer 80, and the contact position of the hammer 80 and the protrusion 61*a* are respectively positioned on the front side with respect to the rotation shaft 52 of the white key 61, the vibration transmission path from the vibration transmission member 70 to the pressable surface of the white key 61 via the hammer 80 is easily formed shorter than the vibration transmission path from the vibration transmission member 70 to the pressable surface of the white key 61 via the rotation shaft 52 of the white key 61.

In addition, the vibration transmission member 70 is provided closer to the rotation shaft 51 of the hammer 80 than the rotation shaft 52 of the white key 61, and the vibration transmission path from the vibration transmission member 70 to the rotation shaft 51 of the hammer 80 is formed shorter than the vibration transmission path from the vibration transmission member 70 to the rotation shaft 52 of the white key 61. Therefore, the vibration transmission path to the pressable surface of the white key 61 via the base member 50 and the hammer 80 can be shortened.

Here, the key pressing feeling associated with the rotation of the hammer 80 can be adjusted by the length from the contact position of the hammer 80 and the white key 61 (protrusion 61*a*) to the rotation shaft 51, the length from the rotation shaft 51 to the back end of the hammer 80, or the weight of the hammer 80. Therefore, if the weight of the hammer 80 is adjusted according to the arrangement of the rotation shaft 51, the desired key pressing feeling can be obtained. That is, although the present embodiment adopts the configuration that the white key 61 (protrusion 61*a*) and the hammer 80 are in contact on the front side with respect to the vibration transmission member 70, for example, if the rotation shaft 51 of the hammer 80 is disposed on the back side with respect to the vibration transmission member 70, the desired key pressing feeling can still be obtained by increasing the weight of the hammer 80.

However, if the rotation shaft 51 of the hammer 80 is disposed on the back side with respect to the vibration transmission member 70, the vibration transmission path from the vibration transmission member 70 to the rotation shaft 51 of the hammer 80 is diverted to the back end side of the white key 61 so the vibration transmission path to the pressable surface of the white key 61 is lengthened correspondingly.

Regarding this, in the present embodiment, the rotation shaft 51 of the hammer 80 is disposed in the region between the contact position of the hammer 80 and the white key 61 (protrusion 61*a*) and the vibration transmission member 70 in the front-back direction. Since the vibration transmission path from the vibration transmission member 70 to the pressable surface of the white key 61 via the hammer 80 is not diverted to the back end side of the white key 61, such a vibration transmission path can be formed shorter.

Thus, by shortening the vibration transmission path to the pressable surface of the white key 61 via the hammer 80, the vibration transmitted from the vibrator 72 to the base member 50 can be efficiently transmitted to the pressable surface of the white key 61 via the base member 50 and the hammer 80.

Also, as described above, the front and back two end portions of the base member 50 are fixed to the chassis 30 (the base member 50 and the chassis 30 are not in contact in the region between the fixing portions), and the amplitude of the vibration tends to be maximum in the substantially central portion of the base member 50 in the front-back direction. However, in the present embodiment, the vibration transmission member 70 and the hammer 80 are respectively disposed at the positions where the amplitude tends to be maximum.

That is, the vibration transmission member 70, the rotation shaft 51 of the hammer 80, and the contact position of the hammer 80 and the white key 61 (protrusion 61*a*) are on the front side with respect to the rotation shaft 52 of the white key 61, and are disposed in the region between the front and back fixing portions (a pair of support members 40) where the base member 50 is fixed to the chassis 30.

Thereby, the vibration from the vibrator 72 is transmitted to the portion of the base member 50 that serves as the antinode of the vibration and the vibration is amplified by the antinode portion of the base member 50, and the amplified vibration can be transmitted to the hammer 80 via the rotation shaft 51. Since the hammer 80 is pivotally supported by the abdomen (portion having relatively low rigidity) of the base member 50, the hammer 80 itself is easily vibrated by the vibration transmitted from the base member 50 as well. Because the vibration of the hammer 80 is transmitted to the pressable surface of the white key 61 via the protrusion 61*a* positioned on the front side with respect to the rotation shaft 52 of the white key 61, the vibration transmitted from the vibrator 72 to the base member 50 can be efficiently transmitted to the pressable surface of the white key 61 via the base member 50 and the hammer 80.

Thus, given that the vibration of the vibrator 72 transmitted from the vibration transmission member 70 to the base member 50 can be efficiently transmitted to the pressable surface of the white key 61, even if the white key 61 disposed at a position away from the vibrator 72 in the left-right direction is pressed, the white key 61 can still be easily vibrated. Therefore, the vibration of one vibrator 72 fixed to the vibration transmission member 70 can vibrate each of the keys 60 arranged on the left and right.

Figure 4A:
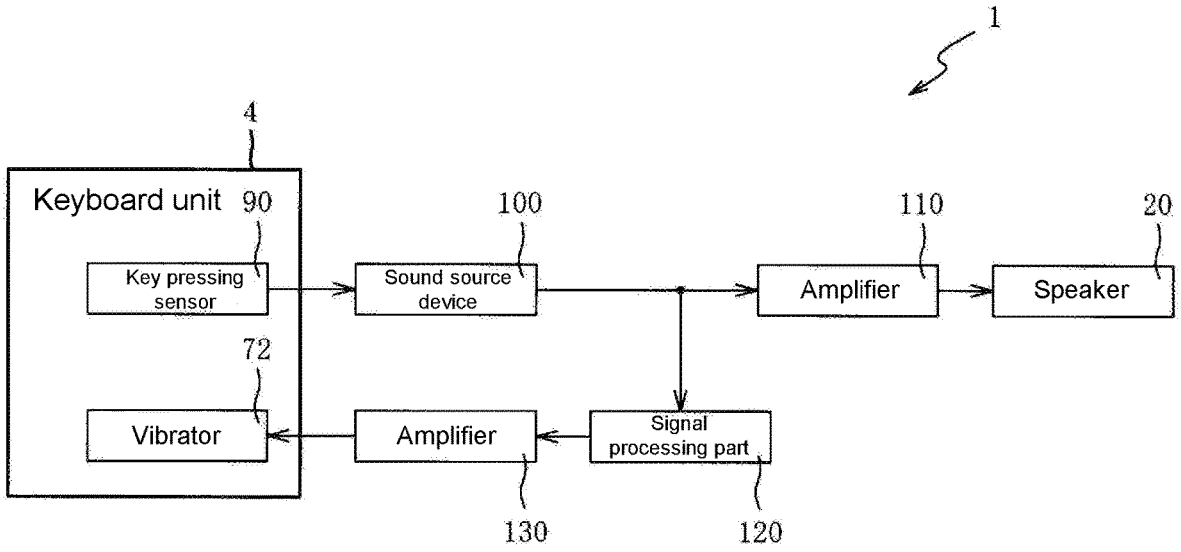
FIG. 4(*a*) is a block diagram schematically showing an electrical configuration of the keyboard device, and FIG. 4(*b*) is a graph schematically showing the magnitude of key vibration felt by the performer when the performer presses the key of an acoustic piano or the keyboard device.
Figure 4B:
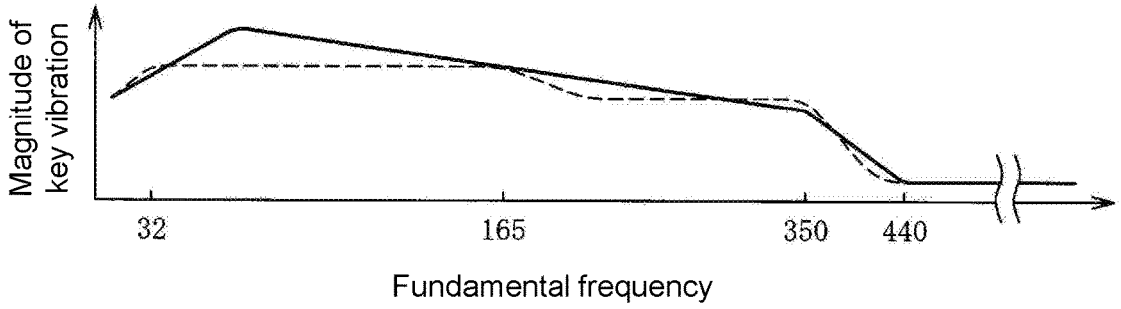

Next, an electrical configuration of the keyboard device 1 will be described with reference to FIG. 4(*a*). FIG. 4(*a*) is a block diagram schematically showing the electrical configuration of the keyboard device 1.

As shown in FIG. 4(*a*), the keyboard device 1 includes a sound source device 100 that generates a musical sound signal based on the key pressing information detected by the key pressing sensor 90 of the keyboard unit 4. The key pressing information detected by the key pressing sensor 90 includes information on the speed (acceleration) when the key 60 (see FIG. 3) is pressed, and the level of the musical sound signal generated by the sound source device 100 is configured to be larger as the speed increases.

While the musical sound signal outputted from the sound source device 100 is outputted to the speaker 20 via an amplifier 110, the musical sound signal outputted from the sound source device 100 is also outputted to the vibrator 72 via a signal processing part 120 and an amplifier 130.

That is, the vibrator 72 is configured to vibrate based on the musical sound signal outputted from the sound source device 100. Since the musical sound signal outputted by the sound source device 100 is a signal of the fundamental frequency corresponding to the pitch name of the key 60 that is pressed, the signal has a low frequency if the pressed key 60 is on the low pitch side, and the signal has a high frequency if the pressed key 60 is on the high pitch side. The fundamental frequency refers to the frequency of the fundamental sound corresponding to the pitch name of the key 60.

The signal processing part 120 is a signal processing device such as an electronic circuit or DSP for processing the musical sound signal outputted from the sound source device 100, and includes a low pass filter that attenuates the musical sound signal outputted from the sound source device 100.

If the fundamental frequency of the musical sound signal outputted from the sound source device 100 is lower than a predetermined frequency (lower than 440 Hz in the present embodiment), the signal processing part 120 outputs the musical sound signal to the amplifier 130 (vibrator 72) without attenuating the level of the musical sound signal. However, if the fundamental frequency of the musical sound signal outputted from the sound source device 100 is higher than the predetermined frequency (440 Hz or higher in the present embodiment), the signal processing part 120 outputs the musical sound signal to the amplifier 130 (vibrator 72) by attenuating the level of the musical sound signal.

Therefore, if the pressed key 60 is a pitch lower than a predetermined pitch (corresponding to a pitch name lower than 440 Hz), the vibrator 72 is vibrated based on the musical sound signal outputted from the sound source device 100. However, if the pressed key 60 is the predetermined pitch or higher (corresponding to a pitch name of 440 Hz or higher), the vibrator 72 can be suppressed from vibrating. Thus, an effect of bringing the feeling close to that of playing an acoustic piano can be obtained, which will be described with reference to FIG. 4(*b*).

FIG. 4(*b*) is a graph schematically showing the magnitude of key vibration felt by the performer when the performer presses the key of an acoustic piano or the keyboard device 1. FIG. 4(*b*) plots the magnitude of key vibration felt at the time of key pressing for each key, in which the vertical axis indicates the magnitude of key vibration felt by the performer and the horizontal axis indicates the fundamental frequency (Hz) corresponding to the pitch name of the key 60 that is pressed. In addition, the graph shown by the broken line in FIG. 4(*b*) indicates the magnitude of key vibration that the performer feels when pressing the key of an acoustic piano, and the graph shown by the solid line indicates the magnitude of key vibration that the performer feels when pressing the key 60 of the keyboard device 1.

As shown in FIG. 4(*b*), in the case where the key of the acoustic piano is pressed alone, the vibration felt during key pressing increases when the key on the low pitch side is pressed, and the vibration felt during key pressing decreases (nearly eliminated) when the key on the high pitch side is pressed.

More specifically, when a key corresponding to a pitch name (C1 to E3) of 32 Hz or higher and lower than 165 Hz is pressed, relatively strong vibration is felt. When a key corresponding to a pitch name (F3 to F4) of 165 Hz or higher and lower than 350 Hz is pressed, slightly weak medium vibration is felt as compared with the case where a key corresponding to a pitch name having a fundamental frequency of 32 Hz or higher and lower than 165 Hz is pressed.

That is, the vibration that the performer feels when pressing the key of the acoustic piano has a peak in a range where the fundamental frequency is 32 Hz or higher and lower than 165 Hz, and the vibration felt decreases when a key on the high pitch side of the range is pressed. However, the vibration felt does not decrease gradually (proportionally) as a key on the higher pitch side is pressed. For a key corresponding to a pitch name (F #4 to G #4) having a fundamental frequency of 350 Hz or higher and lower than 440 Hz, the vibration felt during key pressing decreases sharply, and for a key corresponding to a pitch name (A4 or higher) having a fundamental frequency of 440 Hz or higher, the vibration felt during key pressing is nearly zero.

Regarding this, in the present embodiment, the vibrator 72 (plate 71) is fixed to the vibration transmission member 70 in the region where a key 60 corresponding to a pitch name (A1 to C2) having a fundamental frequency of 55 Hz or higher and lower than 66 Hz is arranged (see FIG. 2). When the fundamental frequency of the musical sound signal outputted from the sound source device 100 is 440 Hz or higher, that is, when a key 60 corresponding to a pitch name (A4 or higher) having a fundamental frequency of 440 Hz or higher is pressed, the vibration of the vibrator 72 is suppressed.

Therefore, when a key 60 corresponding to a pitch name having a fundamental frequency lower than 440 Hz is pressed, the vibration of the pressed key 60 can be increased relatively. On the other hand, when a key 60 corresponding to a pitch name having a fundamental frequency of 440 Hz or higher is pressed, the vibration felt by the performer can be nearly zero. Thus, the performer's feeling can be brought close to that of playing an acoustic piano.

Furthermore, when a key 60 corresponding to a pitch name lower than 440 Hz and a key 60 corresponding to a pitch name of 440 Hz or higher are pressed simultaneously, the vibrator 72 is vibrated by the musical sound signal based on pressing of the key 60 corresponding to the pitch name lower than 440 Hz (that is, at a fundamental frequency lower than 440 Hz). In this case, the vibration transmitted to the left and right along the vibration transmission member 70 is less likely to be attenuated as the fundamental frequency decreases so the vibration of the vibrator 72 at the fundamental frequency lower than 440 Hz is transmitted to the key 60 in the high pitch range of 440 Hz or higher via the vibration transmission member 70.

That is, since the vibration transmission member 70 is fixed to (in contact with) the base members 50 over the range from the low pitch side (an arrangement region of the keys 60 corresponding to pitch names (BO or lower) lower than 32 Hz, for example) to the high pitch side (an arrangement region of the keys 60 corresponding to pitch names (C6 or higher) of 1000 Hz or higher, for example), when a key 60 on the low pitch side and a key 60 on the high pitch side are pressed simultaneously, the vibration of the vibrator 72 based on pressing of the key 60 on the low pitch side can also be transmitted to the key 60 on the high pitch side via the vibration transmission member 70. Two hands of the performer can feel the vibration. Therefore, the performer's feeling can be brought close to that of playing an acoustic piano.

Furthermore, since one vibrator 72 (plate 71) is fixed to the vibration transmission member 70 (the vibration transmission member 70 and the plate 71 are in contact with each other) in the arrangement region of the key 60 corresponding to a pitch name having a fundamental frequency of 55 Hz or higher and lower than 66 Hz, the vibrator 72 can be disposed in the region on the low pitch side where the vibration is most felt in the acoustic piano to efficiently vibrate the keys 60 disposed in the region. That is, since the vibration felt at the time of pressing the keys of the acoustic piano can be simulated by the vibration of one vibrator 72, the product cost can be reduced.

Here, as a method that allows the performer to feel the vibration even in the key 60 on the high pitch side, when the key 60 (corresponding to a pitch name lower than 440 Hz, for example) on the low pitch side and the key 60 on the high pitch side are simultaneously pressed and makes it difficult to feel the vibration when the key 60 (corresponding to a pitch name of 440 Hz or higher, for example) on the high pitch side is pressed alone, a signal generator separate from the sound source device 100 may be provided for the vibrator 72, and a signal may be outputted from the signal generator to the vibrator 72 only when the key 60 on the low pitch side is pressed (ignoring the pressing of the key 60 on the high pitch side). In such a configuration, however, it is necessary to provide a means for determining whether the key on the low pitch side or the high pitch side is pressed and the signal generator for the vibrator 72 needs to be provided separately from the sound source device 100, and the product cost of the keyboard device 1 increases.

Regarding this, in the present embodiment, the vibrator 72 is vibrated by using the sound source device 100 (which outputs a musical sound signal for emitting sound from the speaker 20) so it is not necessary to provide a signal generator separate from the sound source device 100 for the vibrator 72. Furthermore, by utilizing the fact that the fundamental frequency of the signal outputted from the sound source device 100 differs for each pitch name of the key 60, the vibration of the vibrator 72 when the key 60 on the high pitch side is pressed can be prevented simply by providing a low pass filter in the signal processing part 120. That is, it is not necessary to provide a means for determining whether a key 60 on the low pitch side or the high pitch side is pressed. Therefore, the product cost of the keyboard device 1 can be reduced.

The disclosure has been described based on the above embodiments, but the disclosure is not limited to the above embodiments, and it is possible to make various improvements and modifications without departing from the spirit of the disclosure.

Although the above embodiment illustrates that the keyboard device 1 is configured as an electronic piano, the disclosure is not necessarily limited thereto. The technical idea of the above embodiment can also be applied to other electronic musical instruments (such as electronic organs), for example.

Although the above embodiment illustrates that a plurality of base members 50 are arranged in the left-right direction, the disclosure is not necessarily limited thereto. For example, the keys 60 (88 keys) may be supported by a base member 50 composed of one member.

Although the above embodiment illustrates that the base member 50 supports the keys 60 for one octave, the disclosure is not necessarily limited thereto. For example, the base member 50 may support one key 60 (the base member 50 is provided for each key 60).

Although the above embodiment illustrates that the key 60 (white key 61) is supported by the base member 50 to be rotatable around the rotation shaft (rotation shaft 52), the disclosure is not necessarily limited thereto. For example, the key 60 may be connected to the base member 50 via a hinge (plate-shaped member), and the key 60 may be displaced (rotated) by the elastic deformation of the hinge.

Although the above embodiment illustrates that the back end side of the key 60 (white key 61) is pivotally supported by the base member 50, the pivoting position of the key can be set as appropriate as long as it is on the back side with respect to the protrusion (protrusion 61*a*) of the key (white key 61). Thus, the substantially central portion of the key 60 in the front-back direction may be pivotally supported by the base member 50, for example.

Although the above embodiment illustrates that the front and back two end sides (two points) of the base member 50 are fixed to the chassis 30, the disclosure is not necessarily limited thereto. For example, the number of the fixing positions at which the base member 50 is fixed to the chassis 30 may be one (the entire base member 50 is in contact with the chassis 30) or may be three or more. If there are at least two fixing positions at which the base member 50 is fixed to the chassis 30, it may fix the vibration transmission member 70 in the region between the fixing points (the portion, which serves as the antinode of the vibration, of the base member 50). Thereby, the vibration of the vibrator 72 can be amplified by the base member 50.

Although the above embodiment illustrates that the base member 50 is fixed to the chassis 30 via the support members 40, the disclosure is not necessarily limited thereto. For example, the pair of support members 40 may be omitted, and the base member 50 may be fixed directly to the chassis 30.

Although the above embodiment illustrates that the vibration transmission member 70 is fixed from the low pitch side end portion of the base member 50 positioned on the lowest pitch side to the high pitch side end portion of the base member 50 positioned on the highest pitch side, the disclosure is not necessarily limited thereto. For example, the vibration transmission member 70 may not be formed in a part of the region on the high pitch side, and the vibration transmission member 70 may be provided only in the region on the low pitch side. In such a case, the vibration transmission member 70 is disposed in contact with the base member 50 only in the arrangement region of the keys 60 corresponding to the range where the fundamental frequency is lower than 440 Hz. Thereby, the vibration of the vibrator 72 can be effectively suppressed from being transmitted to the key 60 on the high pitch side (corresponding to the range where the fundamental frequency is 440 Hz or higher) via the vibration transmission member 70.

In the above embodiment, the detailed description of the method (contact position) for fixing the vibration transmission member 70 to the base member 50 is omitted. However, the vibration transmission member 70 can be fixed to the base member 50 by fastening with a screw or adhesion with an adhesive as appropriate as long as the vibration transmission member 70 is in contact with at least a plurality of base members 50 respectively (the vibration can be transmitted to the key 60 supported by the base member 50). In addition, the contact positions of the base member 50 and the vibration transmission member 70, formed by the fixation, may be continuous or intermittent in the left-right direction.

Although the above embodiment illustrates that the vibration transmission member 70 is fixed to the lower surface of the base member 50, the disclosure is not necessarily limited thereto. For example, the fixing position at which the vibration transmission member 70 is fixed to the base member 50 can be set as appropriate if the vibration transmission member 70 (plate 71 or vibrator 72) is at a position where it is not in contact with the chassis 30. Thus, the vibration transmission member 70 may be fixed to the back surface, the front surface, or the upper surface (region between the base member 50 and the key 60) of the base member 50, for example.

Although the above embodiment illustrates that the vibration transmission member 70 is fixed to the substantially central portion of the base member 50 in the front-back direction, the disclosure is not necessarily limited thereto. For example, the vibration transmission member 70 may be fixed on the front side or the back side with respect to the center of the base member 50 in the front-back direction.

Although the above embodiment illustrates that the vibration transmission member 70 is made of metal, the disclosure is not necessarily limited thereto. For example, a material other than metal (a resin material having higher rigidity than the base member 50, or a material obtained by insert-molding a metal material into a resin material) may be used to form the base member 50 if the material at least has higher rigidity than the base member 50.

Although the above embodiment illustrates that the vibration transmission member 70 is formed in a rod shape that is long in the left-right direction, the disclosure is not necessarily limited thereto. For example, the vibration transmission member 70 may be formed in a plate shape that is long in the left-right direction like the chassis 30. In such a case, by forming the vibration transmission member 70 in a plate shape that at least has a shorter front-back direction dimension than the chassis 30 (base member 50), the vibration transmission member 70 can be suppressed from vibrating like a diaphragm due to the vibration of the vibrator 72, as compared with the case where the vibrator 72 is fixed to the chassis 30.

Although the above embodiment illustrates that the vibration transmission member 70 is formed in a straight line along the left-right direction, the disclosure is not necessarily limited thereto. For example, the shape of the vibration transmission member 70 is not limited as long as the vibration transmission member 70 is in contact with the base member 50 across the arrangement region of a plurality of keys 60. Therefore, a part of the vibration transmission member 70 that extends to the left and right may be bent (curved) to the front and back, for example.

Although the above embodiment illustrates that the vibration transmission member 70 has a U-shaped cross section (C shape), the disclosure is not necessarily limited thereto. For example, the vibration transmission member 70 may be formed in a prismatic or columnar shape, and the vibration transmission member 70 may be formed solid or hollow.

Although the above embodiment illustrates that one vibrator 72 is fixed to the vibration transmission member 70, the disclosure is not necessarily limited thereto. For example, a plurality of vibrators 72 may be fixed to the vibration transmission member 70.

Although the above embodiment illustrates that the vibrator 72 is supported by the vibration transmission member 70 via the plate 71, the disclosure is not necessarily limited thereto. For example, the vibrator 72 may be fixed directly to the vibration transmission member 70.

The above embodiment illustrates that the vibrator 72 (plate 71) is fixed to the vibration transmission member 70 in the region where the key 60 corresponding to a pitch name having a fundamental frequency of 55 Hz or higher and lower than 66 Hz is arranged. Although not limited to this range, the vibrator 72 (plate 71) is fixed to the vibration transmission member 70 in the region where the key 60 corresponding to a pitch name having a fundamental frequency of 32 Hz or higher and lower than 165 Hz is arranged.

That is, if the vibrator 72 (plate 71) is fixed to the vibration transmission member 70 in the arrangement region of the key 60 corresponding to a pitch name having a fundamental frequency lower than 32 Hz or equal to or higher than 165 Hz, the fixing position of the vibrator 72 (plate 71) is far away from the region where the vibration is most felt (peak of vibration) in the acoustic piano. Therefore, it is difficult to simulate the feeling of playing the acoustic piano (distribution of the vibration felt during key pressing as shown in FIG. 4(*b*)) with one vibrator 72. However, by fixing the vibrator 72 (plate 71) to the vibration transmission member 70 in the region where the key 60 corresponding to a pitch name having a fundamental frequency of 32 Hz or higher and lower than 165 Hz is arranged (the vibration transmission member 70 and the plate 71 are brought into contact), the performer's feeling can be brought close to that of playing the acoustic piano with one vibrator 72.

Although the above embodiment illustrates that the vibrator 72 is vibrated based on the musical sound signal of the sound source device 100, the disclosure is not necessarily limited thereto. For example, a signal generator separate from the sound source device 100 may be provided for the vibrator 72, and a signal may be outputted from the signal generator to the vibrator 72 to vibrate the vibrator 72 only when the key 60 corresponding to a range where the fundamental frequency is lower than 440 Hz is pressed (ignoring the pressing of the key 60 corresponding to the range of 440 Hz or higher).

Although the above embodiment illustrates that the vibrator 72 is vibrated by a fundamental frequency that differs for each key 60 pressed, the disclosure is not necessarily limited thereto. For example, the vibrator 72 may be always vibrated by a constant fundamental frequency regardless of the range of the key 60 pressed.

Although the above embodiment illustrates that the hammer 80 and the key 60 (protrusion 61*a* of the white key 61) are in contact with each other on the front side with respect to the rotation shaft 51 of the hammer 80, the disclosure is not necessarily limited thereto. For example, the hammer 80 and the key 60 may be in contact with each other on the back side with respect to the rotation shaft 51 of the hammer 80. That is, the direction of the hammer 80 in the above embodiment may be reversed in the front-back direction.

Although the above embodiment illustrates that the key 60 and the hammer 80 are pivotally supported by the base member 50, and the key 60 is in contact with the hammer 80 to provide the key pressing feeling, the disclosure is not necessarily limited thereto and the hammer 80 may be omitted. If the hammer 80 is omitted, an elastic member (a coil spring or plate spring, for example) may provide the key 60 the key pressing feeling (return the key 60 to the initial position) in place of the hammer 80. In such a case, the elastic member is disposed on the front side (near the vibration transmission member 70) with respect to the rotation shaft of the key 60 so that the vibration from the vibration transmission member 70 can be efficiently transmitted to the pressable surface of the key 60 via the elastic member.

What is claimed is:

1. A keyboard device, comprising:

a plurality of keys arranged in a scale direction;

a base member supporting the keys;

a vibration transmission member formed with higher rigidity than the base member and being in contact with the base member across an arrangement region of the keys in the scale direction;

a vibrator fixed to the vibration transmission member and vibrating based on a signal generated by pressing of the key; and a chassis supporting the base member, wherein the vibration transmission member and the vibrator are not in contact with the chassis, wherein the base member is fixed to the chassis at at least two positions of a first position and a second position which are spaced at a predetermined interval in a front-back direction, and the base member and the chassis are not in contact with each other in a region between the first position and the second position.

2. The keyboard device according to claim 1, wherein the vibration transmission member is fixed to the base member in the region between the first position and the second position.

3. The keyboard device according to claim 2, wherein the vibration transmission member is fixed to the base member at a substantially intermediate position between the first position and the second position.

4. The keyboard device according to claim 1, wherein the vibration transmission member is formed in an elongated shape that is long in the scale direction by setting an up-down direction dimension and a front-back direction dimension of the vibration transmission member smaller than an up-down direction dimension and a front-back direction dimension of the base member respectively.

5. The keyboard device according to claim 1, comprising a plate that is fixed at one end to the vibration transmission member, wherein the vibrator is fixed to the plate at a position away from a fixing position of the plate and the vibration transmission member.

6. The keyboard device according to claim 1, comprising a hammer being in contact with the key while being pivotally supported by the base member, and rotating with pressing of the key, wherein a vibration transmission path from the vibration transmission member to a front end side of the key through the base member, a pivoting position of the hammer on the base member, the hammer, and a contact position of the hammer and the key is set shorter than a vibration transmission path from the vibration transmission member to the front end side of the key through the base member and a connection position of the base member and a back end side of the key.

7. The keyboard device according to claim 6, wherein the vibration transmission member, the pivoting position of the hammer on the base member, and the contact position of the hammer and the key are respectively provided near the front end side of the key with respect to the connection position of the base member and the back end side of the key.

8. The keyboard device according to claim 7, comprising a chassis supporting the base member, wherein the base member is fixed to the chassis at at least two positions of a first position and a second position which are spaced at a predetermined interval in a front-back direction, and the base member and the chassis are not in contact with each other in a region between the first position and the second position, and the vibration transmission member, the pivoting position of the hammer on the base member, and the contact position of the hammer and the key are respectively disposed in the region between the first position and the second position.

9. The keyboard device according to claim 6, wherein the vibration transmission member is provided near the pivoting position of the hammer on the base member with respect to the connection position of the base member and the back end side of the key.

10. The keyboard device according to claim 1, wherein a plurality of the base members are arranged in the scale direction, and the vibration transmission member connects the base members with each other.

11. The keyboard device according to claim 1, wherein the base member is provided in the scale direction and is composed of one member.

12. The keyboard device according to claim 1, comprising:

a sound source device outputting a signal having a fundamental frequency according to a range of the key that is pressed; and a damping means attenuating a signal having a predetermined frequency or higher among the signal outputted from the sound source device, and outputting the attenuated signal to the vibrator, wherein the vibration transmission member is in contact with the base member from an arrangement region of the keys corresponding to a range where a fundamental frequency is lower than 32 Hz to an arrangement region of the keys corresponding to a range of 1000 Hz or higher, and the vibrator is fixed to the vibration transmission member in an arrangement region of the keys corresponding to a range where a fundamental frequency is lower than 165 Hz.

13. The keyboard device according to claim 12, wherein one vibrator is fixed to the vibration transmission member in an arrangement region of the keys corresponding to a range where a fundamental frequency is 32 Hz or higher.

14. The keyboard device according to claim 1, wherein the vibration transmission member is in contact with the base member only in an arrangement region of the keys corresponding to a range where a fundamental frequency is lower than 440 Hz.

15. The keyboard device according to claim 1, wherein a front end and a back end of the base member are fixed to the chassis via a pair of support members, and the base member supports the keys with an upper surface.

16. The keyboard device according to claim 1, wherein a contact position of the base member and the vibration transmission member is continuous in the scale direction.

17. The keyboard device according to claim 1, wherein contact positions of the base member and the vibration transmission member are intermittent in the scale direction.

18. An electronic musical instrument, comprising the keyboard device according to claim 1.

19. A keyboard device, comprising:

a plurality of keys arranged in a scale direction;

a base member supporting the keys;

a vibration transmission member formed with higher rigidity than the base member and being in contact with the base member across an arrangement region of the keys in the scale direction; and a vibrator fixed to the vibration transmission member and vibrating based on a signal generated by pressing of the key, wherein a plurality of the base members are arranged in the scale direction, and the vibration transmission member connects the base members with each other.

20. A keyboard device, comprising:

a plurality of keys arranged in a scale direction;

a base member supporting the keys;

a vibration transmission member formed with higher rigidity than the base member and being in contact with the base member across an arrangement region of the keys in the scale direction; and a vibrator fixed to the vibration transmission member and vibrating based on a signal generated by pressing of the key, wherein the base member is provided in the scale direction and is composed of one member.

21. A keyboard device, comprising:

a plurality of keys arranged in a scale direction;

a base member supporting the keys;

a vibration transmission member formed with higher rigidity than the base member and being in contact with the base member across an arrangement region of the keys in the scale direction; and a vibrator fixed to the vibration transmission member and vibrating based on a signal generated by pressing of the key, wherein a contact position of the base member and the vibration transmission member is continuous in the scale direction.

22. A keyboard device, comprising:

a plurality of keys arranged in a scale direction;

a base member supporting the keys;

a vibration transmission member formed with higher rigidity than the base member and being in contact with the base member across an arrangement region of the keys in the scale direction; and a vibrator fixed to the vibration transmission member and vibrating based on a signal generated by pressing of the key, wherein contact positions of the base member and the vibration transmission member are intermittent in the scale direction.

* * * * *